US005409076A

United States Patent [19]

Huber et al.

[11] Patent Number: 5,409,076

[45] Date of Patent: Apr. 25, 1995

[54] POWER STEERING SYSTEM FOR MOTOR VEHICLES

[75] Inventors: Gerhard Huber, Kaltental; Bernhard Hollerbach, Steingaden, both of Germany

[73] Assignee: Hoerbiger Ventilwerke Aktiengesellschaft, Vienna, Austria

[21] Appl. No.: 190,488

[22] Filed: Feb. 2, 1994

[30] Foreign Application Priority Data

Feb. 3, 1993 [AT] Austria ..... 181/93

[51] Int. Cl.[6] ..... B62D 5/06

[52] U.S. Cl. ..... 180/132; 114/144 R; 114/150; 440/61; 440/63

[58] Field of Search ..... 180/79, 132, 141, 79.3, 180/79.4; 440/63, 61; 114/144 R, 150

[56] References Cited

U.S. PATENT DOCUMENTS

| | | | |
|---|---|---|---|
| 4,744,777 | 5/1988 | Ferguson | 440/63 |
| 4,892,494 | 1/1990 | Ferguson | 440/63 |
| 5,188,051 | 2/1993 | Huber | 114/150 |

*Primary Examiner*—Mitchell J. Hill

*Attorney, Agent, or Firm*—Watson, Cole, Grindle & Watson

[57] ABSTRACT

A power steering system is actuated by a controller which includes a Bowden cable having a core and a sheath. The core is connected directly mechanically to a control mechanism and the sheath is connected hydraulically to the control mechanism by a control valve and an operating cylinder. To balance a reaction of the control mechanism on the core and thus undesired steering movements of the power steering system, a brake unit is disposed between the core and the sheath of the Bowden cable to prevent relative movement between the two by means of friction.

4 Claims, 2 Drawing Sheets

6
5
1
16
7a
15
20
35
28
30
27
12
8
29
36
26
32
10
31
34
9
18
17
33
18
19
4
20
2
21
24
23
22
11
II
13
14
7
7b
25
FE
FA
3
4

POWER STEERING SYSTEM FOR MOTOR VEHICLES

FIELD OF THE INVENTION

The present invention relates to a power steering system for motor vehicles, particularly for motor boats, and comprises a controller and a control mechanism which can be actuated by way of a cable having a core and sheath commonly known as a Bowden cable. The core is connected directly mechanically to the control mechanism and the sheath is connected hydraulically to the control mechanism by way of a control valve and an operating cylinder.

BACKGROUND OF THE INVENTION

Such systems are known, for example, from U.S. Pat. No. 4,295,833 and German patent publication no. DE-A1 40 39 425. These systems are employed, for example, in motor boats which exhibit high output and which are difficult to steer without the hydraulic power assist. These power steering systems function according to the principle of force-balance, wherein when the controller is actuated not only is a torque exerted on the control mechanism by way of the existing mechanical connection of the core of the Bowden cable, but also a pressure medium connection is also simultaneously steered to or from the respective desired working chamber of the operating cylinder. In this way the steering force exerted at the controller or the steering wheel is intensified in the requisite direction. The control valve is operated by means of the resulting deformation of the Bowden cable. Following completed adjustment of the control mechanism, the deformation of the Bowden cable is cancelled by way of the controller and the control valve returns to its central position, thus concluding the adjustment of the control mechanism. One particular example of a controller being actuated is the manual operation of a steering wheel or the like.

One drawback of such systems is that, especially when accelerating or decelerating vehicles thus equipped, relatively strong forces can in many cases react on the core of the Bowden cable by way of the control mechanism, starting from the drive unit. Because the sheath of the Bowden cable or the components mechanically connected thereto is prevented from moving with the core of the Bowden cable, which is moved by this reaction, at least by way of seals if not also by way of resetting springs or centering springs for the control valve connected to said components, such reaction-induced adjustments of the power steering system cannot be compensated for. The result is a deviation from the straight ahead movement of the vehicle initiated by way of the acceleration or deceleration of the vehicle and its reaction on the power steering, a state that is normally undesired. In addition, the steering wheel moves thereby, if it is not held tight by hand.

SUMMARY OF THE INVENTION

It is an object of the present invention to improve a power steering system of the aforementioned kind such that the cited drawbacks of the known systems are avoided. More particularly, it is an object of the present invention to provide a power steering system for a motor vehicle wherein reactions from the acceleration or deceleration phases of the vehicle on the power steering is prevented by simple means.

The problems associated with a system of the aforementioned kind are solved according to the present invention by providing a brake unit which prevents the relative movement between the core and the sheath of the Bowden cable or components mechanically connected thereto by means of a friction element disposed therebetween. Thus, in the case of the aforementioned mechanical reaction of the control mechanism on the core of the Bowden cable and the resulting adjustment of the same, the sheath of the Bowden cable and thus the control valve are also dragged along. This results in a hydraulic counter-action as the control valve functions against the reaction by way of the operating cylinder. Thus, an undesired change in direction of the accelerated vehicle can be prevented in a very simple manner, without having to hold the controller tightly during the acceleration or deceleration phases of the vehicle.

It is clear that the brake unit has to produce an amount of frictional force relative to the core of the Bowden cable or a component mechanically connected thereto that the frictional force is overcome by seals, bearings, and the like. The resetting force of a resetting or centering mechanism acting on the control valve must also be able to overcome the frictional force exerted by the brake unit. Starting from this threshold, it is ensured that the mechanical reaction on the core of the Bowden cable can also lead to a hydraulic adjustment of the cylinder by way of the control valve, so as to compensate for the reaction.

At the same time it should be pointed out that the resetting or centering springs, which to date have usually existed in systems of the aforementioned kind, are not actually necessary for the power steering to function and serve merely to allow the resistance forces, while steering, to be felt at the controller, e.g., the steering wheel. This feature greatly facilitates the manual operation of such steering systems. Therefore, in the present case, a suitable resetting or centering spring can be omitted since the resistance that the operator expects while operating the power steering is made available by way of the brake unit.

In another embodiment of the invention, the core of the Bowden cable rigidly penetrates the piston of the control valve which is designed in the shape of a sleeve and is connected to the sheath. The brake unit is arranged on an end of the sleeve piston of the control valve. The result is a very simple design, which can also be added later on known systems of the aforementioned kind.

According to the preferred embodiment of the invention, the brake unit can exhibit a housing, preferably in the form of a screw cap, which is attached to the sleeve piston. The screw cap holds a frictional element on the rigid core and is held virtually without play in the axial direction. The result is a very simple design, where, by way of the design and the attachment of the frictional element, the function of the control valve can be readily varied with the core of the Bowden cable which is influenced byway of the mechanical reaction.

In an especially preferred embodiment of the invention, the frictional element can be designed as a friction ring which is divided or severed at least on one side and held on the rigid core by means of an external spring washer. This feature enables further improvement in the affect on the resetting behavior of the control valve with the core of the Bowden cable and uses simple and easy to acquire or variable components.

BRIEF DESCRIPTION OF THE DRAWINGS

The invention is explained in more detail with reference to the following description and with the aid of the exemplary embodiment depicted diagrammatically in the drawings, wherein.

DETAILED DESCRIPTION OF A PREFERRED EMBODIMENT

Figure 1:
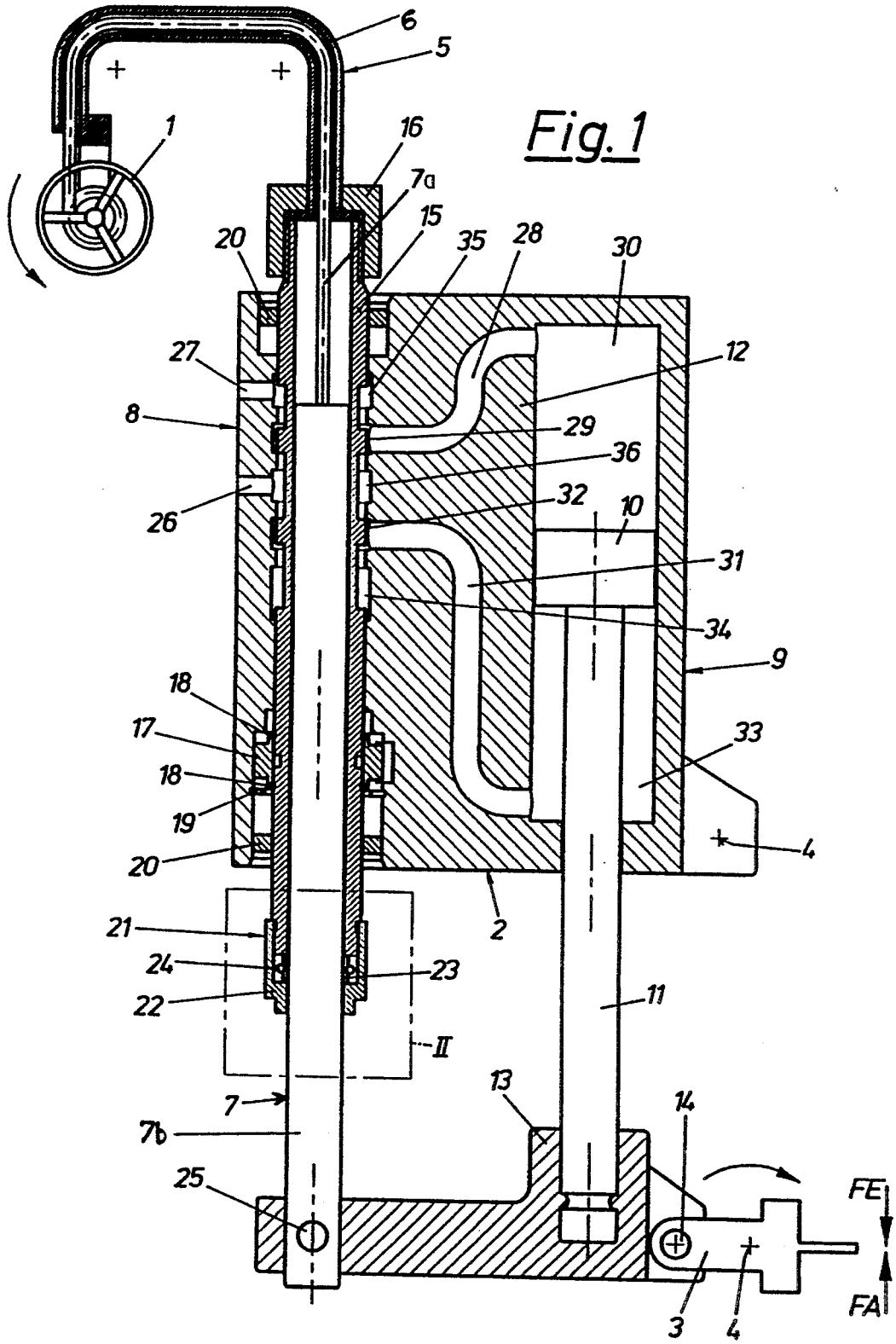
FIG. 1 is a diagrammatic cross sectional view of a power steering system according to the present invention.

The power steering system depicted diagrammatically in FIG. 1 comprises in essence a steering wheel 1, serving as the controller, a component 2 to assist the hydraulic steering, and a control mechanism 3, for example, the rudder or so-called Z drive of a motor boat. Apart from that, the control mechanism 3 could, of course, also be integrated into the steering system of a land vehicle or act with a steering system. In the illustrated embodiment both the control mechanism 3 and the component 2 can be swiveled around an axle 4 mounted stationarily, for example, in the boat body of a motor boat (not shown in detail).

The steering wheel 1 is also anchored stationarily at the boat body in a manner that is also not illustrated in detail. From the steering wheel 1, a Bowden cable 5, which exhibits a sheath 6 and a core 7, runs to the component 2, consisting in essence of a control valve 8 and an operating cylinder 9. The core 7 comprises a portion 7*a* connected to steering wheel 1 and substantially surrounded by sheath 6, and a portion 7*b* connected to portion 7*a* and substantially surrounded by sleeve piston 15. A piston operator 10 and the corresponding piston rod 11 are arranged in the operating cylinder 9. The piston rod 11 is guided sealingly to the outside through the housing 12 in a manner that is not shown in detail here and connected shape-lockingly to a lever 13, which in turn is connected to the control mechanism 3 by way of a bolt 14.

A piston 15 is housed in the valve housing 12 and belongs to the control valve 8. The piston 15 is designed in this embodiment as a sleeve piston or slider and is connected to the sheath 6 of the Bowden cable by way of a threaded nut 16. Coaxially to the sleeve piston 15 is a stop sleeve 17, which is held by means of two retaining rings 18. Another retaining ring 19 is disposed in the housing 12, with which the sleeve piston 15 can move in the axial direction only by the necessary or allowed stroke.

The sleeve piston 15 is sealed with a seal 20 toward the outside on the upper and bottom side as seen in the drawing. Apart from the illustrated design, the sleeve piston 15 and the stop sleeve 17 can also be designed naturally as one piece, thus omitting the retaining rings 18.

Figure 2:
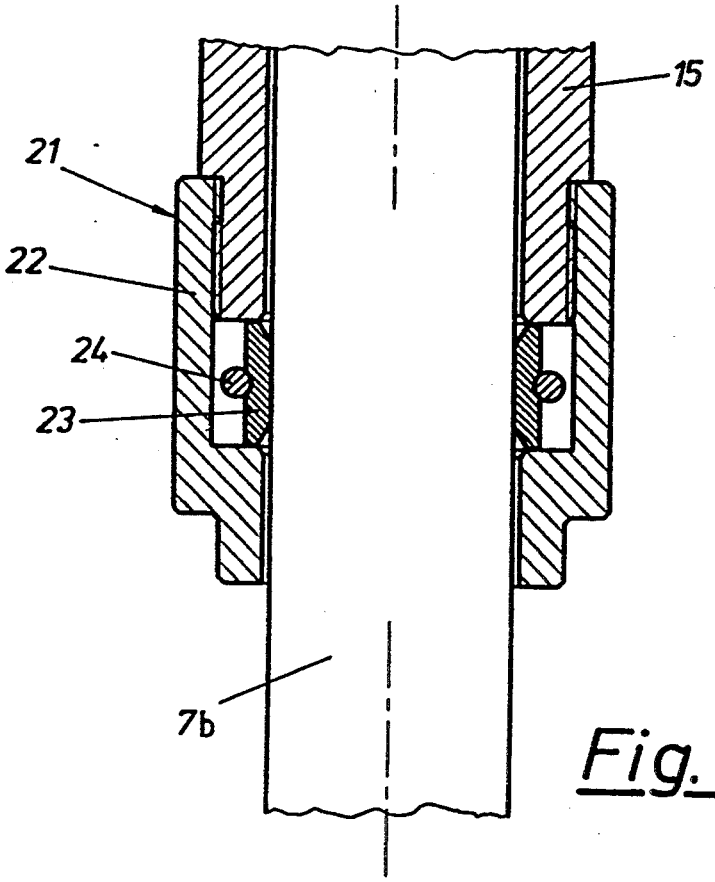
FIG. 2 depicts an enlarged detail of the area II taken from FIG. 1.

A braking unit 21, which is shown on an enlarged scale in FIG. 2, is arranged on the side of the sleeve piston 15 opposite the threaded nut 16. The housing 22, designed along the lines of a screw cap, is connected to the sleeve piston 15 by way of threads. Between the housing 22 and the sleeve piston 15 is a frictional element 23, which is held on the rigid core portion 7*b* of the Bowden cable 5 by means of an external spring washer 24. A bolt 25 connects the lever 13 to the core portion 7*b* and thus produces a rigid connection between core. 7, lever 13 and piston rod 11. The frictional element 23 is held rigidly on the core such that it is substantially free of play in an axial direction.

The housing 12 is provided with the necessary ports for a pressure medium pump 26 and a port 27 leading to a tank that is not shown in detail. The annulus 29 is connected by means of a channel 28 to the cylinder chamber 30, which is designed on the side of the operating cylinder 9 facing away from the piston rod 11. Another channel 31 in turn connects the annulus 32 to the control valve 8 to the cylinder chamber 33 on the side of the piston rod 11. The two annuluses 34 and 35 for the tank port are connected together by way of a borehole (not illustrated here).

The illustrated power steering functions according to the principle of force-balance. By operating the steering wheel 1 a torque is exerted on the control mechanism 3 not only by way of the existing mechanical connection through the core 7, but also by the pressure medium supply and discharge to and from the desired cylinder chamber 30 or 33 which is also controlled at the same time. In so doing the steering force is intensified in the desired direction. The sleeve piston 15 of the control valve 8 is operated by means of a deformation of the Bowden cable 5. Between the rigid portion 7*b* of the core and the sleeve piston 15 that is directly connected to the sheath 6 of the Bowden cable, there is a frictional force that takes along the piston 15 in the respective direction of movement of the core. Likewise, the sheath 6 is also moved in the respective direction of movement of the core because of its direct connection to the piston 15. As the sheath is forced toward or away from the steering wheel, depending upon the direction of rotation of the steering wheel, the sheath becomes deformed relative to its non-deformed central position. Following completed adjustment of the control mechanism 3, the sheath returns to its central position so as to relieve the stress caused by its deformation, and the deformation of the Bowden cable 5 is cancelled. The sleeve piston 15 then returns again to its central position thus concluding the adjustment of the control mechanism 3.

In the central position of the sleeve piston 15, the two cylinder chambers 30 and 33 are connected without pressure to the tank port 27 by means of the two channels 28 and 31 and the annuluses 34 and 35.

The power steering is operated by means of the Bowden cable 5 in the following manner. When the steering wheel 1 is rotated counterclockwise to the left, the core 7 of the Bowden cable responds to pull, whereby a force is exerted in the "move-in" direction on the operating piston by way of the bolts 25, the lever 13 and the piston rod 11. Similarly, the control mechanism 3 moves clockwise into the desired direction of rotation. At this stage the core 7 of the Bowden cable 5 tries to occupy an elongated position within the sheath 6, whereby the sheath 6 adapts to this elongated position and moves the piston 15 downward in the drawing. In this position the pressure medium port 26 is connected by way of the annulus 36, the channel 31 and the cylinder chamber 33. Similarly, the cylinder chamber 33 is connected to the tank port 27. The result is that the pressure medium flowing into the cylinder chamber 33 adjusts the operating piston 10 and piston rod 11 also in the "move-in" direction. The power steering system is operated as desired with the aid of the operating cylinder 9.

When the steering wheel 1 is moved clockwise, the directions of movement described above have only to be reversed, thus adjusting the operating piston 10 in the "move-out" position.

In particular, when a vehicle equipped with such power steering is accelerated or decelerated, forces act, starting from the drive unit, on the lever 13 and thus on the operating piston 10. By way of the bolt 25, forces thus also act on the core 7 of the Bowden cable 5. Since the two seals 20 exert a frictional force on the sleeve piston 15, the piston cannot move freely in the axial direction and thus counteract this acceleration force.

Thus, the following occurs in detail. Assuming that the acceleration force FE acts, as presented, on the control mechanism 3, the result is a movement which acts clockwise on the control mechanism 3 and thus moves the lever 13, the piston rod 11, the operating piston 10 and the core 7 of the Bowden cable 5 upward, in the "move-in" direction. The upward moving core 7 of the Bowden cable 5 moves the steering wheel 1 counterclockwise, provided it is not held tight by hand. A boat equipped with such a steering would thus move in a curve to the left in an uncontrolled and undesired manner.

The same happens for an acceleration force (or deceleration force) FA going up in the drawing, except that the steering wheel 1 moves in the opposite direction.

These acceleration or deceleration effects according to FE or FA as described above are prevented by the brake unit which is shown in detail in FIG. 2. If the acceleration force FE acts as stated, the core 7 of the Bowden cable 5 moves, as described above, toward the top in the drawing. Since, however, the frictional element 23, prestressed by means of the spring washer 24, produces a resulting frictional force, the sleeve piston 15 of the control valve 8 is also moved upwardly against the frictional force of the seals 20. However, a movement of the sleeve piston 15 toward the top in the drawing causes a hydraulic reaction force in the "move-out" direction. Thus, this circumstance prevents an undesired directional change of the vehicle without having to hold the steering wheel 1 tight.

Since at this stage the resetting or centering spring, which is usually present for the purpose of returning the piston 15 into the central position, is not present here, in essence only the friction of the seals 20 has to be overcome by means of the frictional element 23, whereby the steering still functions relatively easily. The aforementioned stop sleeve 17 serves only to limit the stroke of the sleeve piston 15.

The relevant feature in the illustrated design is that between the rigid portion **7*b* of the core 7 and the sleeve piston 15 that is directly connected to the sheath 6 of the Bowden cable 5, there is a frictional force that takes along the piston 15 in the respective direction of movement of the core 7. Apart from the illustrated embodiment of an annular frictional element 23 and spring washer 24**, other designs known to the expert for such brake units are also conceivable and possible within the scope of the present invention.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A power steering system for a motor vehicle, said system including a direction control means for determining a direction of movement of the motor vehicle, a steering means, a cable core connected between said steering means and said direction control means for moving said direction control means in opposite first and second directions to thereby determine the direction of movement of the motor vehicle, a control valve and an operating cylinder connected to said direction control means to hydraulically assist said cable in moving said direction control means in one of said first and second directions, a cable sheath surrounding a first length of said cable core and connected to said control valve, and a braking means connected to said control valve and contacting a rigid second length of said cable core connected to said first length for frictionally inhibiting relative movement between said cable core and said cable sheath.

2. A power steering system for a motor vehicle according to claim 1, wherein said control valve includes a sleeve piston axially movable therein, one end of said sheath is connected to said sleeve piston, said cable core is rigid and extends through said sleeve piston so as to define an end portion which projects outwardly of said control valve, and said braking means contacts said end portion of said cable core.

3. A power steering system for a motor vehicle according to claim 1, wherein said sleeve piston includes an end portion which extends outwardly of said control valve, and said braking means is attached to said end portion of said sleeve piston.

4. A power steering system as defined in claim 3, wherein said braking means includes a friction element which contacts said end portion of said cable core, and an external spring washer, said friction element being in the shape of a friction ring having at least one separation along the ring and being held around the rigid second length of said core by said external spring washer.

* * * * *